United States Patent [19]

Forster

[11] 4,396,434

[45] Aug. 2, 1983

[54] PROCESS FOR CLEANING SURFACES FOULED BY DEPOSITS RESULTING FROM COMBUSTION OF CARBON-BEARING SUBSTANCES

[75] Inventor: Marc-André Forster, La-Celle-St.-Cloud, France

[73] Assignee: Somalor-Ferrari "Somafer" SA, France

[21] Appl. No.: 320,301

[22] Filed: Nov. 12, 1981

[30] Foreign Application Priority Data

Nov. 26, 1980 [FR] France ..... 80 25389

[51] Int. Cl.[3] ..... B08B 3/12; F23J 3/00

[52] U.S. Cl. ..... 134/1; 110/343; 110/344; 122/379; 122/380; 134/19; 134/20; 134/22.16; 432/2

[58] Field of Search ..... 134/1, 2, 19, 20, 22.16; 110/343, 344, 345; 122/379, 380; 165/84; 432/2

[56] References Cited

U.S. PATENT DOCUMENTS

| | | | |
|---|---|---|---|
| 621,884 | 3/1899 | Wilson | 110/344 |
| 2,351,163 | 6/1944 | Thomas | 165/84 X |
| 2,664,274 | 12/1953 | Worn et al. | 165/84 X |
| 2,935,956 | 5/1960 | Welch | 110/343 |
| 3,234,580 | 2/1966 | Keck | 110/343 X |
| 3,457,108 | 7/1969 | Hittel | 134/1 X |
| 3,544,366 | 12/1970 | Uhlmann | 134/2 |
| 3,835,817 | 9/1974 | Tuomaala | 122/379 |

FOREIGN PATENT DOCUMENTS 1357992 3/1964 France .

*Primary Examiner*—Marc L. Caroff

*Attorney, Agent, or Firm*—McDougall, Hersh & Scott

[57] ABSTRACT

A process for cleaning surfaces of installations fouled by products of combustion of carbon-bearing materials, such as in particular boiler combustion chambers, rotary or static heat exchangers, combustion product ducts and flues, electrostatic filters, etc., which are to be cleaned without having to stop the combustion process, in order to maintain maximum thermal efficiency in order thereby to make a substantial energy saving, in which an aqueous solution of ammonium nitrate and potassium nitrate is injected into the installation, the deposited substances being detached from the installation by means of sound sources.

9 Claims, 3 Drawing Figures

PROCESS FOR CLEANING SURFACES FOULED BY DEPOSITS RESULTING FROM COMBUSTION OF CARBON-BEARING SUBSTANCES

The present invention relates to a process for cleaning surfaces of an installation, which are fouled by incrusting or non-incrusting deposits resulting from the combustion of carbon-bearing substances, which can be performed without having to stop the combustion process.

The man skilled in the art knows that any combustion operation using carbon-bearing substances, whether they are in the form of a gas, a liquid or a solid, is generally accompanied on the one hand by the emission of more or less hot gases and, on the other hand, the formation of incombustible mineral products and unburnt carbon products. These products are more or less entrained into the circuits through which the gases pass, and they may either be deposited on the surface thereof, or react chemically with the constituent materials of such surfaces, or, by virtue of the high temperature and the composition of such products, fuse and adhere to the surfaces in question. This therefore results in the formation of deposits which are incrusting to a greater or lesser degree.

Such deposits foul the surfaces with which they are in contact, which can have troublesome consequences when, as in the case of heat generators, such surfaces are the surfaces of exchangers which are required to transmit a flow of heat to a fluid circulating on the other side of the surfaces.

In fact, the deposits formed reduce the transfer coefficient of the surface and result in a reduction in the level of thermal efficiency of the installations, which sometimes requires the installations to be shut down.

It has therefore been found necessary periodically to clean the fouled surfaces, in order to remove such deposits or at least to restrict the amount of deposit to an acceptable value.

Current practice is for the cleaning operation to be carried out by blowing a fluid under pressure such as steam, water or air, on to the surface to be cleaned. The pressure fluid acts at the same time or separately as a cooling agent causing the deposits to contract, and as a mechanical agent for breaking up the deposits.

However, this process involves using fluid circuits in which the fluid is under a pressure of several tens of bars, and is applied only to surfaces which can be directly reached by the jet of fluid, thereby preventing this process from being used in installations in which circuits have baffles or are of a winding configuration.

Moreover, such a process is generally performed when there is no combustion process going on, that is to say, when the installation is shut down; if this is not the case, it is necessary to have recourse to blowing heads which are so designed that they can be exposed to the action of hot gases which have a corrosive effect to a greater or lesser degree, without suffering from damage.

Another conventional process, which undoubtedly enjoys a certain amount of efficiency, involves washing the fouled surfaces. However, in that case, the process encounters the problem of deposits which do not dissolve easily or which give rise to acid solutions resulting in corrosion and failure of the constituents materials of the installation. This process also suffers from the disadvantage that the installation to be cleaned must inevitably be shut down for a fairly long period of time, which gives rise to substantial losses in productivity when the installation is part of a continuously operating manufacturing unit.

The man skilled in the art also knows that he can overcome this cleaning problem by shot blasting the surfaces of the installation. However, such a procedure can only be used in installations of a particular design and which are of a suitable layout. Hence, this type of process is of very limited interest.

It is also possible to use chemical cleaning which comprises, for example, soaking the surfaces to be cleaned with a solution of ammonia to neutralize the sulphuric anhydride present in the deposits to be removed. However, this method suffers from the same disadvantages as those referred to hereinbefore.

It is for this reason that the applicants, being desirous of making their contribution to a problem which is all the more serious since energy saving and therefore ways of maximizing the efficiency of heat exchangers are nowadays an aim of primary importance for industrialists, sought and developed a process, and it is an object of this invention to provide a process, for cleaning and maintaining in a clean condition, surfaces which are fouled by deposits resulting from the combustion of carbon-bearing substances, such that the cleaning process can be carried out without generally having to stop the combustion process in the installation, that is to say, without interfering with operation of the production units which are dependent thereon. This process also has the following advantages: it makes it possible to clean off the most strongly adhering deposits on surfaces which provide difficult access, without having recourse to using washing solutions which give rise to corrosion phenomena, or equipment consuming prohibitive amounts of energy, and without particular adaptation or modification in the installation to be cleaned.

The process is characterized in that at least one substance, capable of reacting chemically with the mineral and carbon-bearing deposits fouling the surfaces, is injected into the installation, and that the particles resulting from the chemical reactions are displaced by being brought into phase with acoustic air waves in order to cause them to be entrained by the flow of air or combustion gas or to fall towards the ash receptacles of the installation.

Thus, the cleaning process is characterized firstly in that at least one substance capable of reacting chemically with the carbon-bearing and mineral deposits resulting from combustion of carbon-bearing materials is injected into the installation.

The chemical reaction is to cause, most generally, oxidation of the deposits. When dealing with carbon-bearing deposits, the deposits undergo combustion and are therefore destroyed; when dealing with mineral deposits, an oxidation reaction occurs, which results in an increase in volume and therefore causes the crystalline structures of the deposits to be broken up. However, this structural destruction effect can also be induced by chemical reactions of the decomposition reaction and/or substitution reaction type. The chemical reaction must also be such that it can take place under high-temperature chemistry conditions.

From the point of view of the nature of the injected substance, the applicants preferably use an oxidizing agent and in particular a nitrate or a mixture of nitrates such as potassium nitrate and ammonium nitrate which, when used in the form of an aqueous solution, are of a concentration of the order of 200 to 300 g/liter.

In some cases, in order to prevent any corrosion, it is preferable for the solutions to be adjusted to a pH above 9, by adding thereto ammonia or any other substance capable of stabilizing the pH-value of the deposits.

Moreover, the injected substance always contains corrosion inhibitors required to prevent the constituent materials of the system from undergoing chemical attack. It is possible to use substances capable of inducing neutralization and/or substitution reactions. Selection of the components of the injected substance and the amounts of injected substance also takes account of the regulations applicable in regard to atmospheric pollution.

Preferably, the substance is used in a divided state in order to provide for contact with the maximum surface area of the carbon-bearing and mineral deposits and consequently accelerate chemical reduction.

The divided state of the injected substance may be further increased by injecting the substance in the form of a solution which is atomized by means of ultrasonic atomizers or any other means capable of producing a suitable dispersion, the amount and geographical location of which essentially depend on the structure of the installation to be cleaned. However, they are generally so arranged that the cloud of minute particles that they produce does not come into contact with the flame resulting from combustion of the carbon-bearing materials. The atomizers may be installed specifically for the cleaning operation or permanently in the existing apertures in the installation, for example at the inspection openings.

The substance may be injected continuously throughout the cleaning period, or in a programmed fashion. Thus, under the action of the injection operation within the hot region of the installation, the sprayed substance which is entrained by the gases resulting from combustion is rapidly brought into contact with the mineral and carbon-bearing deposits with which is reacts, causing combustion thereof or the desired chemical reaction. These reactions cause them to be fragmented into a fine state, which will enhance subsequent movement thereof under the effect of the acoustic waves.

With the system to be cleaned being in normal operation during the operation of injecting the substance, the temperatures at which the reactions occur are between 300° and 1000° C. so that the reactions are very rapid and even involve high temperature chemistry.

The second feature of the invention therefore comprises displacing the particles resulting from the chemical reactions, in order to cause them to be entrained in the combustion gas circuit or to fall towards the ash receptacles of the installation. The particles are set in motion in this manner by bringing them into phase with acoustic air waves produced by sound vibration sources. The vibration sources emit vibration at audible frequencies, for example, 250 Hertz. It is in the audio frequency range that the sound sources are most effective for the desired displacement, but it is possible to use infra-sonic or ultra-xonic sources for certain deposits.

From the power point of view, a range of between 100 and 200 decibels per source is to be used.

The sound sources are disposed at positions which are suitably selected in dependence on the characteristics of the installation, the nature, geographical situation and the amount of deposits to be removed. They are spaced from each other at greater or lesser distances, depending on their radius of action. The design of the sources should be such that they can withstand temperatures ranging up to 1000° C., without suffering damage. They are installed in position of use at the time of the cleaning operation, or are permanently installed.

Thus, under the combined effect of the injected substance and the acoustic waves, the fouling deposits on the surfaces of the installation are reduced to a more or less powdery mass of particles, which are either entrained by the combustion gases and possibly removed by electrical precipitators, or re-deposited at certain locations in the installation, for example in the lower parts of the installation where it does not interfere with heat exchange and from which it can be removed at any time or when the installation is shut down, depending on the design of the installation.

The present invention is illustrated by the drawings accompanying the application which show different types of installation to which the claimed process can be applied, in which:

Figure 1:
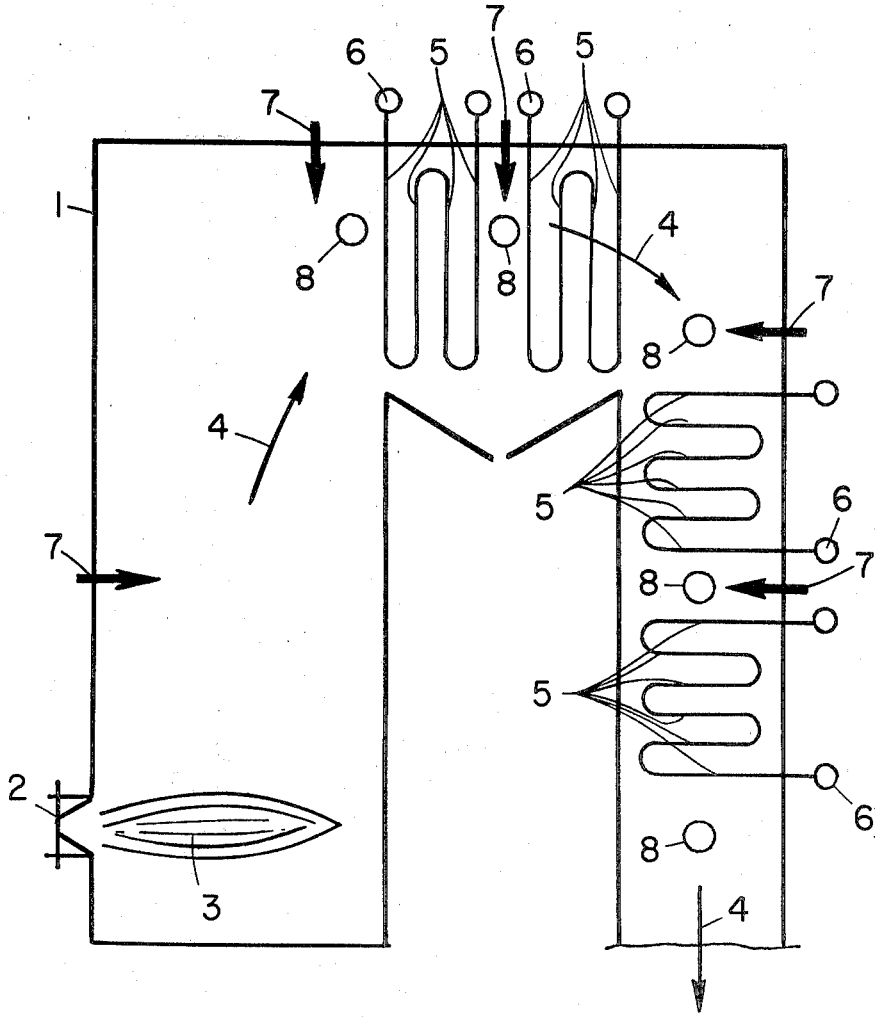
FIG. 1 is a diagrammatic elevational view of a high-power boiler, embodying means for carrying out the invention.

FIG. 1 is a diagrammatic view in vertical section of a high-power boiler 1 provided with a burner 2 producing a flame 3 which generates hot gases which circulate in the direction indicated by the arrows 4, accompanied by carbon-bearing products and mineral products which are deposited on the surfaces 5 of four exchangers 6. Four spraying means 7 disposed at different places in the boiler inject the substance capable of chemically reacting with the fouling deposits on the surfaces, while five sound sources 8 have been placed on each of the two side faces of the installation which are parallel to the axis of the burner.

Figure 2:
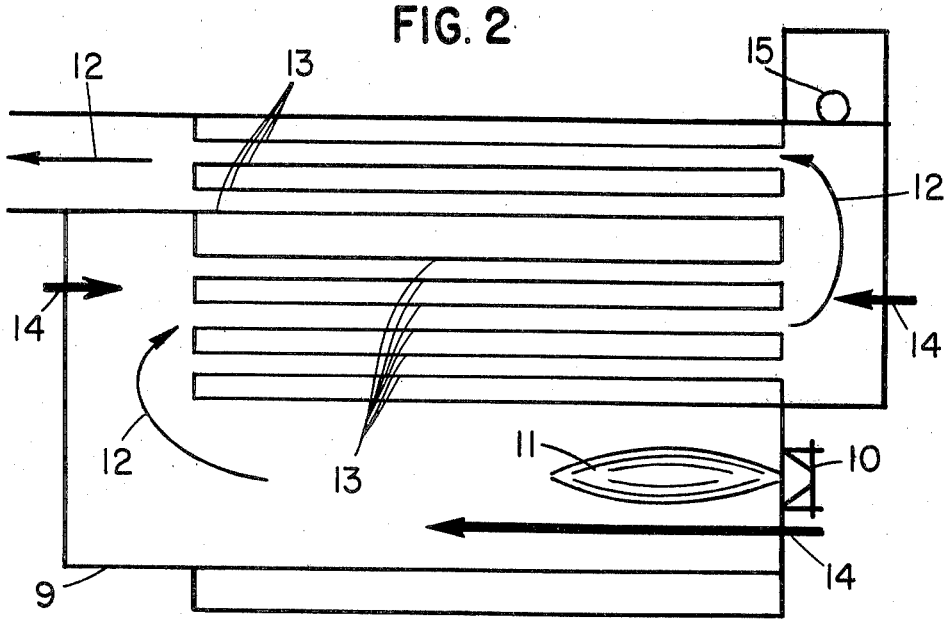
FIG. 2 is a diagrammatic elevational view of a low-power boiler.

FIG. 2 shows a view in vertical section of a low-power steel boiler 9 for producing hot water or vapor, provided with a burner 10 producing a flame 11 resulting in gases which circulate in the direction indicated by arrows 12, leaving behind a part of the solid products which accompany the gases, on the exchange surfaces 13. For the purposes of carrying out the process, three injectors 14 are provided, while a sound source 15 has been set in position between the two tube nests of the installation.

Figure 3:
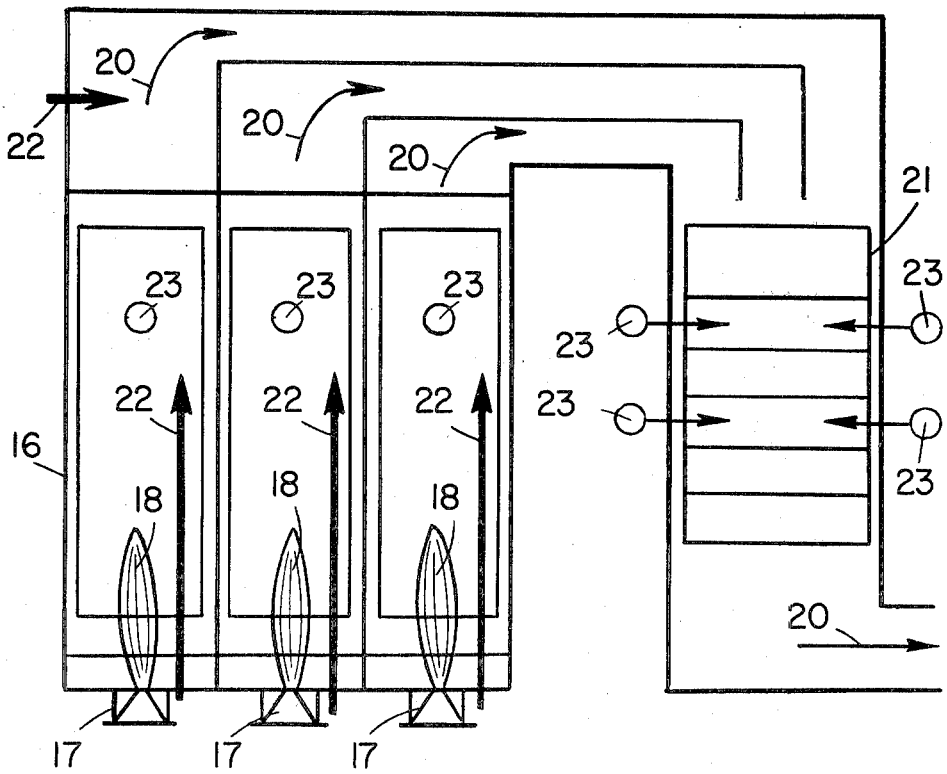
FIG. 3 is a diagrammatic elevational view of a refinery furnace.

FIG. 3 shows a view in vertical section of a refinery furnace 16 consuming 70 tons of heavy fuel oil per day. The furnace has three burners 17 which produce flames 18 in each of the three radiation cells 19. The combustion gases circulate in the direction indicated by the arrows 20 and leave a part of the suspended particles entrained thereby, deposited on the surfaces of the exchangers 21. Three spraying means 22 have been disposed close to each of the burners, and a fourth spraying means is positioned at the outlet of the radiation cells, while the installation also has seven sound sources 23, three of which have been placed on one of the side walls of the installation at the position of the cells, while the other four sound sources have been positioned at the exchangers 21.

In order to assist in comprehension of the invention, two examples of use of the invention will now be described.

EXAMPLE 1

A conventional coal-fired superheated-water boiler with a heat output of 10,000 large calories per hour, in permanent operation, was treated during operation using the process of the invention for cleaning both the radiation regions and heat exchange regions.

The procedure was as follows: 200 liters of a solution containing 155 g/l of ammonium nitrate and 135 g/l of potassium nitrate, adjusted to a pH-value of close to 9.3 by the addition of ammonia, was injected for a time of 60 minutes, in four periods each of 15 minutes, with a break of 30 minutes between each injection operation.

During the injection period, the draught of the boiler was reduced to the minimum in order to avoid losses of substance through the flue and four sound sources installed on the walls of the boiler were set in operation for 10 seconds every 15 minutes at a frequency of 250 Hz and at a sound level of 140 decibels. The sound sources were kept in operation for 24 hours after the end of the injection procedure, to complete the cleaning action. The particles, which were detached from the surfaces were entrained by the flow of combustion gases and removed by an electrical precipitator.

The thermal efficiency of the boiler, which had fallen to 85% of normal, returned to close to 98% after treatment.

EXAMPLE 2

A refinery furnace of the type shown in FIG. 3, consuming 300 tons of heavy fuel oil per day, which had been in service for more than 6 months, was treated using the process of the invention, to clean the combustion cells and the exchangers. For that purpose, 5000 liters of a solution containing 115 g/l of ammonium nitrate and 135 g/l of potassium nitrate, adjusted to a pH-value of 9.3 by the addition of ammonia, was injected over five periods of 30 minutes, separated by rest periods of 30 minutes.

Following each injection period, seven sound sources distributed in the manner shown in FIG. 3 were set in operation for 15 seconds.

After the particles had been entrained by the combustion gases or deposited in the bottom of the installation, the thermal efficiency of the installation which had dropped to 80% was restored to 95% of the usual normal level.

This process is used in cleaning surfaces of installations such as in particular boiler combustion chambers, rotary or static heat exchangers, combustion product ducts and flues and electrostatic filters, which are to be cleaned without having to stop the combustion process, in order to maintain maximum thermal efficiency in order thereby to achieve a substantial energy saving.

I claim:

1. A process for cleaning the surfaces of an installation, which are fouled by deposits resulting from combustion of carbon-bearing materials, comprising injecting an aqueous solution into the installation for dispersion with gases resulting from the combustion while the combustion gases flow through the installation, said aqueous solution containing a mixture of potassium nitrate and ammonium nitrate in which the proportion of ammonium nitrate in the mixture is greater than 15% by weight, and subjecting the deposits and reaction products to acoustic air waves sufficient to displace the products from said surfaces whereby the products are entrained by the flow of combustion gas or fall to the bottom of the installation.

2. A process according to claim 1 in which the solution is an aqueous solution containing a combined total of 200 to 300 g/l of said nitrates.

3. A process as claimed in claim 1 in which the solution injected is an aqueous solution adjusted to a pH above 9 by the addition of ammonia.

4. A process according to claim 1 in which the solution contains at least one corrosion inhibitor.

5. A process according to claim 1 in which the solution is injected outside the combustion regions.

6. A process according to claim 1 in which the particles of the reaction are brought into phase with waves at audible frequencies.

7. A process according to claim 1 in which the acoustic waves are produced by sound vibration sources each having a power output of between 100 and 200 decibels.

8. A process according to claim 7 in which the sound vibration sources are capable of withstanding temperatures of up to 1000° C.

9. A process as claimed in claim 1 in which the solution injected is an aqueous solution containing a substance capable of stabilizing the pH value of the deposits.

* * * * *